US012330197B2

(12) United States Patent
Chu et al.

(10) Patent No.: US 12,330,197 B2
(45) Date of Patent: Jun. 17, 2025

(54) LARGE-SCALE AXLE INTELLIGENT CROSS WEDGE ROLLING MILL FOR RAIL TRANSIT

(71) Applicant: TAIYUAN UNIVERSITY OF SCIENCE AND TECHNOLOGY, Shanxi (CN)

(72) Inventors: Zhibing Chu, Shanxi (CN); Baoyu Wang, Shanxi (CN); Zhongkai Ren, Shanxi (CN); Shulin Li, Shanxi (CN); Yugui Li, Shanxi (CN); Xinliang Zhou, Shanxi (CN); Xianan Huang, Shanxi (CN); Junsheng Xu, Shanxi (CN); Jianxin Qin, Shanxi (CN); Yafeng Ji, Shanxi (CN); Jinping Liu, Shanxi (CN)

(73) Assignee: TAIYUAN UNIVERSITY OF SCIENCE AND TECHNOLOGY, Shanxi (CN)

( * ) Notice: Subject to any disclaimer, the term of this patent is extended or adjusted under 35 U.S.C. 154(b) by 828 days.

(21) Appl. No.: 17/575,121

(22) Filed: Jan. 13, 2022

(65) Prior Publication Data

US 2022/0136558 A1 May 5, 2022

Related U.S. Application Data

(63) Continuation of application No. PCT/CN2021/080676, filed on Mar. 15, 2021.

(30) Foreign Application Priority Data

Feb. 8, 2021 (CN) ..... 202110183803.5

(51) Int. Cl.
*B21B 13/02* (2006.01)
*B21B 19/16* (2006.01)

(52) U.S. Cl.
CPC ..... *B21B 19/16* (2013.01); *B21B 13/023* (2013.01)

(58) Field of Classification Search
CPC ..... B21B 13/023; B21B 13/02; B21B 31/02; B21B 31/08; B21B 31/12
See application file for complete search history.

(56) References Cited

FOREIGN PATENT DOCUMENTS

CN 102553927 A * 7/2012

* cited by examiner

*Primary Examiner* — Debra M Sullivan

(57) ABSTRACT

A large-scale axle intelligent cross wedge rolling mill for rail transit includes a main transmission device, a memorial arch unit, two worm-gear pressing devices, a roll assembly and two guide devices. The separation sleeves are engaged with the upper slide shaft and the lower slide shaft, respectively. Two lower shaft necks are detachably connected with the left end surface and the right end surface of the lower roller, respectively; two upper shaft necks are detachably connected with the left end surface and the right end surface of the upper roller, respectively, so that the quick disconnection of the upper and lower rollers with the upper and lower shaft necks is able to be achieved, so as to quickly operate and install the roll to meet the requirement of quick mold replacement, thus improving the flexibility of rolling.

10 Claims, 13 Drawing Sheets

LARGE-SCALE AXLE INTELLIGENT CROSS WEDGE ROLLING MILL FOR RAIL TRANSIT

CROSS REFERENCE OF RELATED APPLICATION

This is a Continuation Application of the International Application PCT/CN2021/080676, filed on Mar. 15, 2021, which claims the benefit of CN 202110183803.5 and priority date of Feb. 8, 2021.

BACKGROUND OF THE PRESENT INVENTION

Field of Invention

The present invention relates to the field of plastic forming equipment for shaft parts, and more particularly to a large-scale axle intelligent cross wedge rolling mill for rail transit.

Description of Related Arts

Large-scale axles are core components in high-speed rail, rail transit, large-scale construction machinery and other fields, and are increasingly needed. The traditional preparation method of large-scale shaft parts includes a step of forgoing by fast forging machines and precision forging machines. The fast forging process requires human intervention, is long in production cycle, low in product accuracy, high in energy consumption, and low in efficiency. Its subsequent production process requires heavy cold processing, which greatly destroys the metal streamlines on the surface of the product and reduces the mechanical properties of the product while the amount of cutting is large. The precision forging machine is completely monopolized by foreign companies. Moreover, the forging speed is able to be above doubled than the fast forging speed and the amount of cutting is effectively reduced, but it still takes at least 4 minutes to prepare an axle. The subsequent processing loss and product mechanical properties are still not improved, the equipment input and output are relatively low, and the quality stability is poor.

Cross wedge rolling is an efficient and clean plastic forming technology for parts. Compared with existing production methods, it has some advantages as follows. (1) The production efficiency is increased by 2 to 3 times. (2) The material saving rate is increased by 10 to 25%. (3) The product precision is high, and machining procedures are reduced. (4) No impact and low noise. (5) The production cost is reduced by about 30%. Take the production of train RD2 axles as an example: the preparation time of a single axle is reduced from 10 minutes to 1 minute, the production efficiency is increased by 3 to 5 times, the material saving is 50-100 Kg, and the material saving rate is increased by 10-20%. Therefore, the use of cross wedge rolling technology to prepare large-scale axles for rail transit not only improves the efficiency and accuracy of axle forming, but also improves the axle life due to the retention of hot-worked metal streamlines.

At present, the largest cross wedge rolling mill in the world is only able to roll large-scale shafts with a diameter of 150 mm and a length of 1200 mm or less. For large-scale shaft products with a diameter in a range of 200-250 mm and a length in a range of 2000-2800 mm used in high-speed rail, rail transit, large-scale construction machinery and other fields, the overall design and the critical structure reliability of the radio equipment are required. Moreover, rolling mill molds are relatively large in size and weight, and the existing cross wedge rolling devices are unable to meet the needs of efficient preparation of large-scale axles in terms of structural type and mold replacement method. At the same time, it is impossible to dynamically monitor the working status of the rolling mill, and it is difficult to fully grasp the service life and working effect of the device. Accordingly, it is very important to adopt the certain structure and method to solve the above problems. Therefore, a new type of intelligent cross wedge rolling mill needs to be proposed for overcoming the above problems.

In the design process of the traditional cross wedge rolling mill, due to the small rolling force, the traditional cross wedge rolling mill is small in size and high in reliability, and the corresponding die is also small in weight and size, so that There is no risk of equipment being easily damaged. However, for large-scale axle cross wedge rolling mill, because the diameter of the roller is 1800 mm, the maximum of the rolling force reaches 820 tons, and the maximum width of the die reaches 2900 mm, the mill has high power requirements and it is difficult to determine whether each key structure and function meets the production requirements. If the traditional structure is still adopted, the use effect of the large-scale axle cross wedge rolling mill will be greatly affected.

SUMMARY OF THE PRESENT INVENTION

Aiming at the above problems, the present invention provides a large-scale axle intelligent cross wedge rolling mill for rail transit.

The present invention provides technical solutions as follows.

A large-scale axle intelligent cross wedge rolling mill for rail transit comprises a main transmission device, a memorial arch unit, two worm-gear pressing devices, a roll assembly and two guide devices, wherein:

- the main transmission device comprises a main drive motor, a primary reducer and a transfer case, wherein an output shaft of the main drive motor is connected with an input shaft of the primary reducer, an output shaft of the primary reducer is connected with an input shaft of the transfer case, two output shafts of the transfer case are connected with an upper transmission shaft and a lower transmission shaft through two universal couplings, respectively, the two output shafts of the transfer case rotate in a same direction;
- the memorial arch unit comprises a left memorial arch, a right memorial arch, an I-beam for connecting a lower end of the left memorial arch with a lower end of the right memorial arch, and two C-shaped beams for connecting an upper end of the left memorial arch with an upper end of the right memorial arch, wherein the C-shaped beams are used to give way for lifting out and replacing a roller;
- the two worm-gear pressing devices are installed at the upper end of the left memorial arch and the upper end of the right memorial arch, respectively;
- the roll assembly comprises two upper bearing seats and two lower bearing seats, wherein:
  - one of the two upper bearing seats and one of the two lower bearing seats are installed within the left memorial arch, another of the two upper bearing seats and another of the two lower bearing seats are installed within the right memorial arch;

two clamping sleeves fixed on an upper surface of the two upper bearing seats, respectively;

to an end portion of two pressing screws of the two worm-gear pressing devices is provided within the two clamping sleeves for connecting the two worm-gear pressing devices with the two upper bearing seats, respectively;

an upper transmission shaft and an upper slide shaft are provided within the two upper bearing seats, respectively;

a lower transmission shaft and a lower slide shaft are provided within the two lower bearing seats, respectively;

two upper shaft necks are integrated with an inner side end of the upper transmission shaft and an inner side end of the upper slide shaft, respectively;

two lower shaft necks are integrated with an inner side end of the lower transmission shaft and an inner side end of the lower slide shaft, respectively;

a distance between the two lower shaft necks is smaller than a distance between the two upper shaft necks;

the two lower shaft necks are detachably connected with a lower roller, the upper shaft necks are detachably connected with an upper roller;

four separation sleeves are provided between the upper slide shaft and one of the two upper bearing seats, between the lower slide shaft and one of the two lower bearing seats, between the upper transmission shaft and another of the two upper bearing seats, between the lower transmission shaft and another of the two lower bearing seats, respectively;

the separation sleeves adopt an internal spline key structure form, the upper slide shaft or the lower slide shaft adopts an external spline key structure form, two of the four separation sleeves are engaged with the upper slide shaft and the lower slide shaft, respectively, so that the upper slide shaft and the lower slide shaft have an axial sliding function and torque transmission function;

eight limit rings are provided at two ends of the four separation sleeves, respectively; two labyrinth covers are provided between two of the eight limit rings and the one of the two upper bearing seats, another two labyrinth covers are provided between another two of the eight limit rings and the one of the two lower bearing seats;

multiple positioning sleeves are provided between the eight limit rings and eight bearing end covers, respectively, such that one of the two of the four separation sleeves, two of the eight bearing end covers and the one of the two upper bearing seats are connected with each other as a whole, another of the two of the four separation sleeves, another two of the eight bearing end covers and the one of the two lower bearing seats are connected with each other as a whole;

two end portions of two piston rods of two clamping hydraulic cylinders are rotatably connected with an external side of one end of the upper slide shaft and that of the lower slide shaft, respectively;

two cylinder bodies of the two clamping hydraulic cylinders are fixedly installed on two protective cases, respectively;

the two protective case are connected with the eight bearing end covers, respectively;

an expansion and contraction of the two clamping hydraulic cylinders are able to realize an axial movement of the upper slide shaft and the lower slide shaft;

the two guide devices are located at a front side and a rear side of the memorial arch unit.

Preferably, the external side of the one end of the upper slide shaft and that of the lower slide shaft are connected with two connection sleeve bodies through screws, respectively; two connection sleeve end covers are connected with the two connection sleeve bodies through screws, respectively; two opposite surfaces of the two connection sleeve bodies and the two connection sleeve end covers have two installation slots and two limit slots, respectively; the two connection sleeve bodies and the connection sleeve end covers form two connection sleeves, respectively; the two end portions of the two piston rods of the two clamping hydraulic cylinders are rotatably connected with the two connection sleeves, respectively; two bearings are provided between the two installation slots and the two piston rods of the two clamping hydraulic cylinders, respectively; two circular limit blocks which match with the two limit slots are provided on the two piston rods of the two clamping hydraulic cylinders, respectively.

Preferably, two first positioning hooks are integrated with the two lower shaft necks, respectively for positioning the lower roller; a left side and a right side of the lower roller have two first positioning surfaces which are corresponding to the two first positioning hooks, respectively; the two first positioning surfaces have two first hook grooves which match with the two first positioning hooks, respectively; the two upper shaft necks have two second positioning surfaces for positioning the upper roller, two second positioning hooks are located at a left side and a right side of the upper roller and are corresponding to the two second positioning surfaces, respectively, the two second positioning surfaces have two second hook grooves which match with the two second positioning hooks, respectively.

Preferably, four guide keys are located at a middle portion of two inner side end surfaces of the two upper and lower shaft necks along a vertical direction, respectively; all of two side faces of the upper roller and two side faces of the lower roller have four guide grooves which match with the guide keys, respectively.

Preferably, all of the two inner side surfaces of the two upper shaft necks and the two inner side surfaces of the two lower shaft necks have four first horizontal slots, respectively; all of the two side faces of the upper roller and the two side faces of the lower roller have four second horizontal slots which are communicated with the four first horizontal slots, respectively; four strengthen keys are inserted into the four first horizontal slots and the four second horizontal slots, respectively, so as to improve a torque transmission capacity between the two lower shaft necks and the lower roller, the two upper shaft necks and the upper roller; each of the four strength keys is fixedly connected with an adjacent lower shaft neck and the lower roller, or is fixedly connected with an adjacent upper shaft neck and the upper roller through screws.

Preferably, all of two side walls of an upper roller and two side walls of a lower roller have multiple first rectangular through holes circumferentially evenly provided therein; all of the two upper shaft necks and the two lower shaft necks have multiple second rectangular through holes, wherein the multiple first rectangular through holes are communicated with the multiple second rectangular through holes one to one, respectively; multiple T-shaped bolts are inserted between the multiple first rectangular through holes and the multiple second rectangular through holes, respectively; two fixture blocks are provided at an inner side of each of the multiple first rectangular through holes and are symmetrical to each other with respect to a diagonal line of the each of the multiple first rectangular through holes, in such a manner that after an T-shaped end portion of each of the multiple T-shaped bolts is inserted into one of the multiple second rectangular through holes, which is communicated with the each of the multiple first rectangular through holes, and is rotated by 90 degrees, the each of the multiple T-shaped bolts is stuck between the two fixture blocks to avoid rotation; another end portion of the each of the multiple T-shaped bolts penetrates through the one of the multiple second rectangular through holes and is threadedly connected with a nut; while disassembling the upper roller and the lower roller, the T-shaped bolts are loosened and reversely rotate by 90 degrees, so that the T-shaped bolts are quickly pulled out.

Preferably, two axial movement devices, which are respectively located at an external side surface of the two lower bearing seats, comprises two slider seats fixed on an external side of the two lower bearing seats through bolts;

the two protective cases are provided at an external end surface of the two slider seats, respectively;

two of the four separation sleeves corresponding to the two lower bearing seats, the lower bearing seats, the two slider seats and four of the eight bearing end covers corresponding to the two lower bearing seats are respectively connected with each other as a whole through four of the limit rings corresponding to the two lower bearing seats, so that the movement of the roll assembly and the axial sliding of the lower slide shaft do not interfere with each other;

two inclined sliders are provided at a front side and a rear side of each of the two slider seats, respectively;

the two inclined sliders are slidably provided within an inclined slide slot of a movement adjustment block, the movement adjustment block is moved up and down to push or compress the two inclined sliders for further axially moving the each of the lower bearing seats;

a limit slider is provided at a side of the movement adjustment block which is close to the left memorial arch or the right memorial arch, the left memorial arch or the right memorial arch has a limit slide slot which matches with the limit slider;

one end of a movement hydraulic cylinder is hinged with a lower end of the movement adjustment block, another end of the movement hydraulic cylinder is hinged with the left memorial arch or the right memorial arch, so as to drive the movement adjustment block to move up and down;

a first lock ramp slider and a lock block is provided at an external side of the movement adjustment block, a second lock ramp slider which is corresponding to the first lock ramp slider is provided on the lock block, the movement adjustment block is locked through the second lock ramp slider compressing the first lock ramp slider;

the lock block has multiple lock slide slots, both the left memorial arch and the right memorial arch have multiple lock bolts which match with the multiple lock slide slots, respectively, so as to limit the lock block to slide along the lock slide slots;

one end of a locking hydraulic cylinder is hinged with a lower end of the lock block, another end of the locking hydraulic cylinder is hinged with the memorial arch unit.

Preferably, two dovetailed limit blocks are provided at a middle portion of an upper end surface of the two lower bearing seats, respectively; two prestressed plates are located above the lower bearing seats, respectively; a lower surface of the two prestressed plates has two dovetailed slots which matches with the two dovetailed limit blocks, respectively; two prestressed seats are provided at a front end and a rear end of an upper surface of each of the two prestressed plates, respectively; two prestressed threaded rods are provided within and threadedly connected with the two prestressed seats, respectively; an upper portion of the two prestressed threaded rods has two limit grooves, respectively; two connection covers are inserted into the two limit grooves, and are fixedly connected with two connection blocks which are provided on a lower surface of the two upper bearing seats through screws, respectively; the two connection blocks are fixedly connected with the two upper bearing seats, respectively; two first pressure sensors are provided between the two prestressed threaded rods and the two connection blocks for detecting the prestressed force, respectively; two creepmeters are inserted into the left memorial arch and the right memorial arch for detecting deformation thereof, respectively.

Preferably, each of the two guide devices comprises two installation seats, wherein the two installation seats are fixed on the left memorial arch and the right memorial arch, respectively;

a tie rod is installed between the two installation seats for applying a transverse prestressed force between the left memorial arch and the right memorial arch;

a guide plate seat is sleeved on the tie rod;

two hinge ears are provided at a left end and a right end of an external side of the guide plate seat, respectively;

two guide hydraulic cylinders are hinged with the two hinge ears, respectively; an upper end of the two guide hydraulic cylinders are hinged with the left memorial arch and the right memorial arch, respectively;

an upper surface of the guide plate seat has a guide slot; the guide slot and the two hinge ears are provided at two sides of the tie rod, respectively;

a guide plate is inserted into the guide slot, the guide plate seat is connected with the guide plate through bolts, the guide plate has multiple bolt slide slots therein, a bolt limit block is rotatably installed at a middle portion of an external side of the guide plate, the bolt limit block is fixedly connected with an end portion of a fastening bolt, the fastening bolt is threadedly connected with an external side wall of the guide slot, two spacers are provided between the guide plate and the external side wall of the guide slot, respectively, the two spacers are connected with the guide plate seat through screws, two second pressure sensors are provided between the two spacers and the guide plate, respectively, a guide bar is connected with an inner side of the guide plate through bolts.

Preferably, four fixed frames are provided at an upper surface and a lower surface of a left side and a right side of the guide plate seat, respectively, a side surface of the fixed frames is connected with the left memorial arch or the right memorial arch through screws for enhancing a stability of the guide plate seat in a rolling process.

Compared with the prior art, the present invention has advantages as follows.

(1) In the present invention, two lower shaft necks are detachably connected with the left end surface and the right end surface of the lower roller, respectively; two upper shaft necks are detachably connected with the left end surface and the right end surface of the upper roller, respectively, so that the quick disconnection of the upper and lower rollers with the upper and lower shaft necks is able to be achieved, so as to quickly operate and install the roll to meet the requirement of quick mold replacement, thus improving the flexibility of rolling.

(2) In the present invention, the roll mold is able to be quickly replaced in accordance with the product rolling specification, and the replacement time is able to be reduced from the traditional 2 days to 0.5 days, which meets the requirements of rolling time for products with different specifications.

(3) The clamping hydraulic cylinder provided by the present invention is able to increase a certain axial force in the rolling process of axle, which effectively eliminates the axial movement caused by rolling bearing clearance and machining errors, and avoids the asymmetry of the upper and lower molds due to the above factors, thereby improving the overall size and accuracy of products.

(4) The present invention is able to realize dynamic monitoring and adjustment of rolling force, prestress, guide plate force and roll transverse force, so as to realize intelligent control of large-scale axle wedge rolling process.

Figure 1:
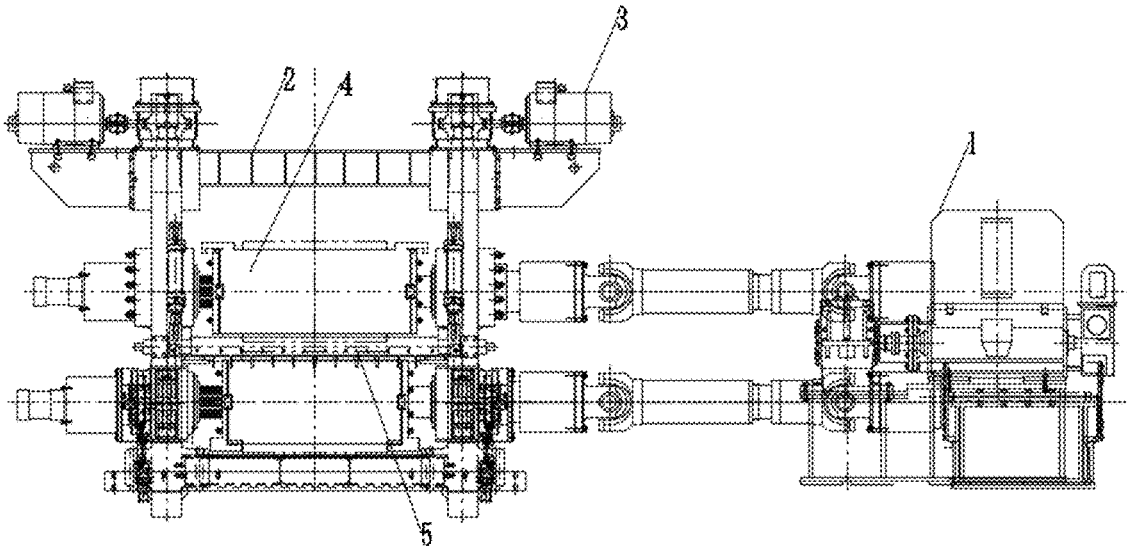
FIG. 1 is a structural schematic view of a large-scale axle intelligent cross wedge rolling mill for rail transit provided by the present invention.
Figure 2:
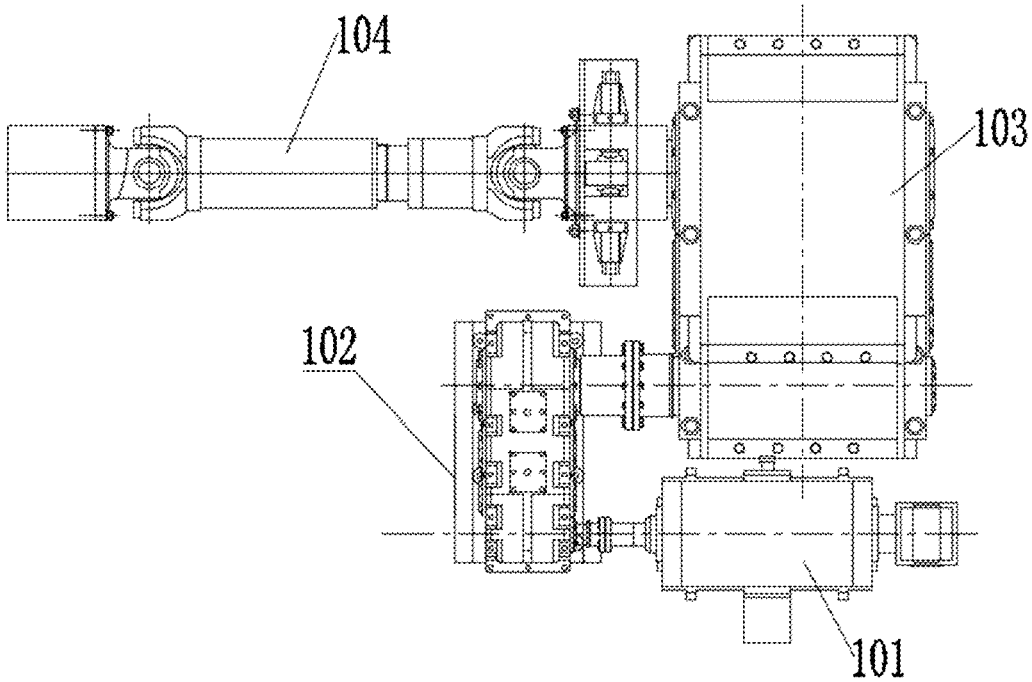
FIG. 2 is a structural schematic view of a main transmission device of the large-scale axle intelligent cross wedge rolling mill provided by the present invention.
Figure 3:
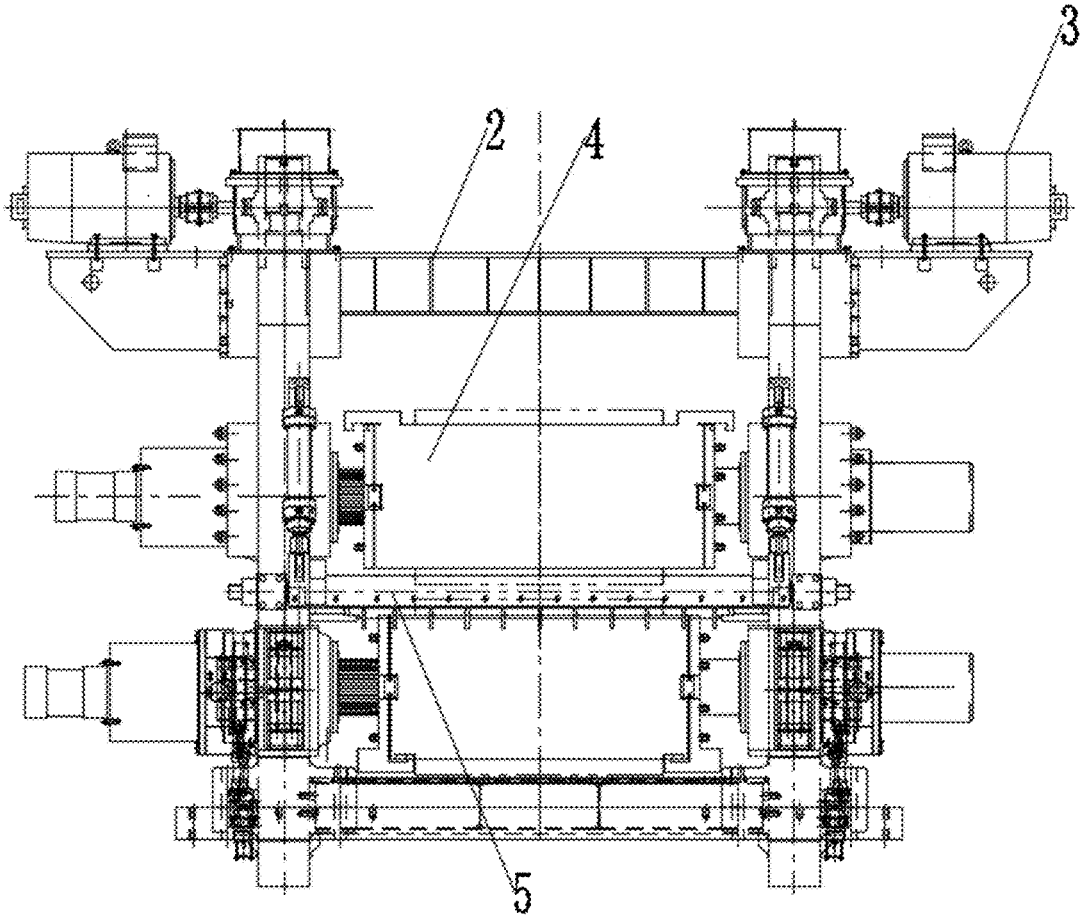
FIG. 3 is a main view of the large-scale axle intelligent cross wedge rolling mill without the main transmission device provided by the present invention.
Figure 4:
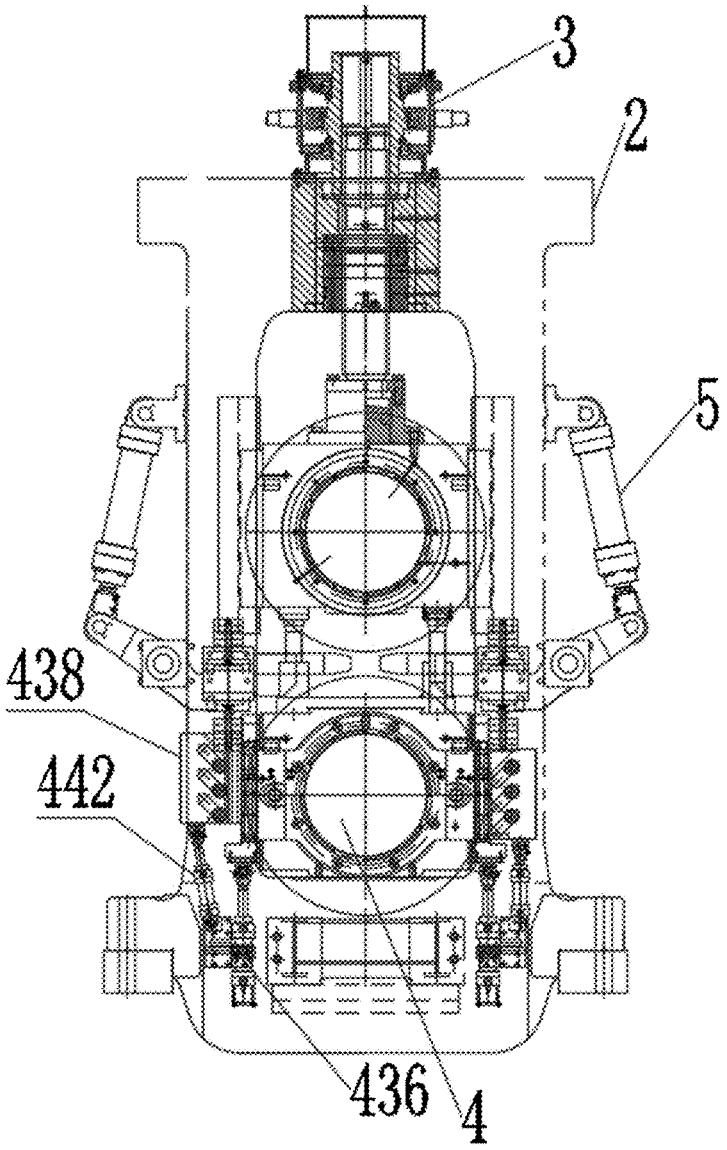
FIG. 4 is a side view of the large-scale axle intelligent cross wedge rolling mill without the main transmission device provided by the present invention.
Figure 5:
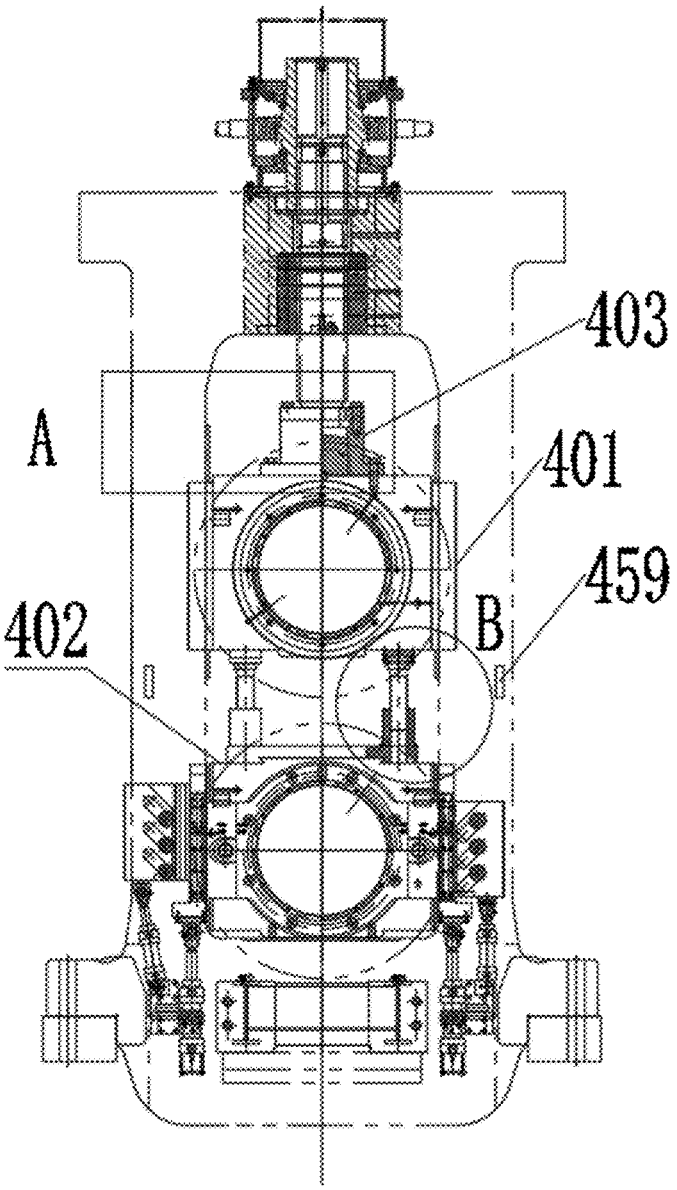
FIG. 5 is a side view of the large-scale axle intelligent cross wedge rolling mill without the main transmission device or guide device provided by the present invention.
Figure 6:
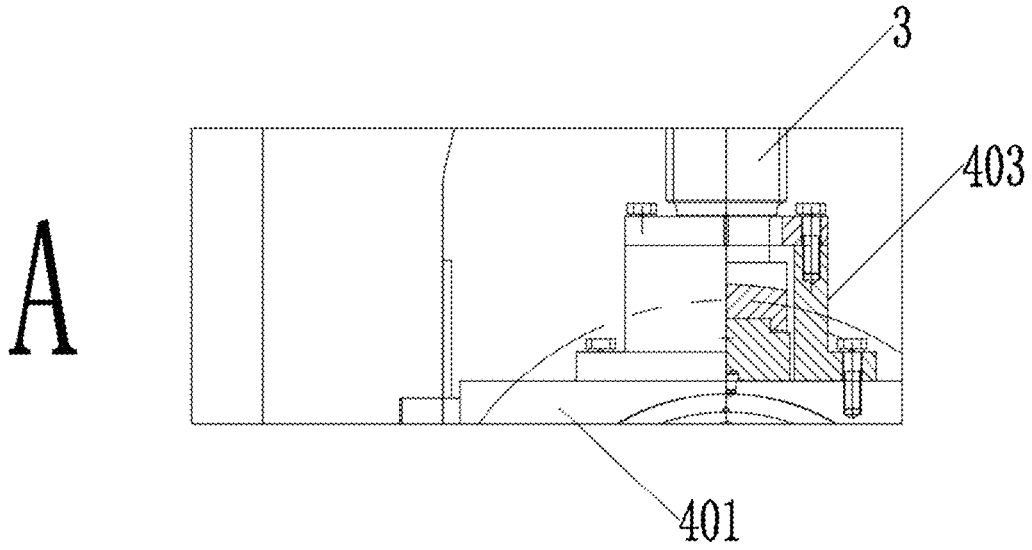
FIG. 6 is a partial enlarged view of block A in FIG. 5.
Figure 7:
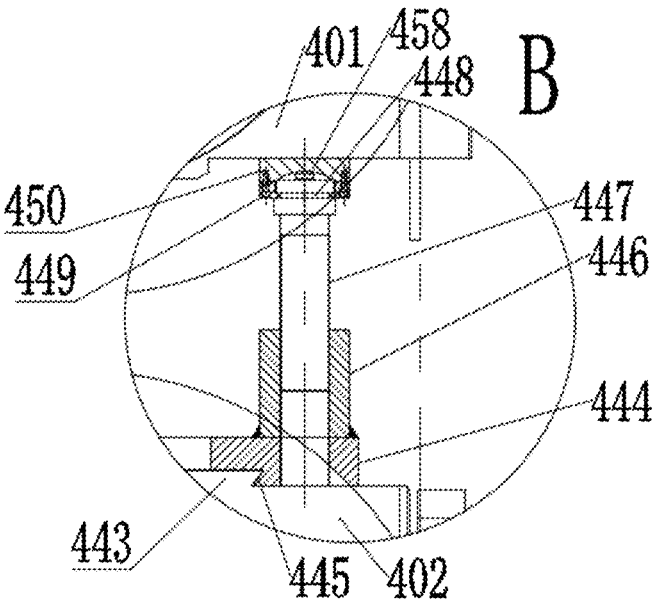
FIG. 7 is a partial enlarged view of circle B in FIG. 5.
Figure 8:
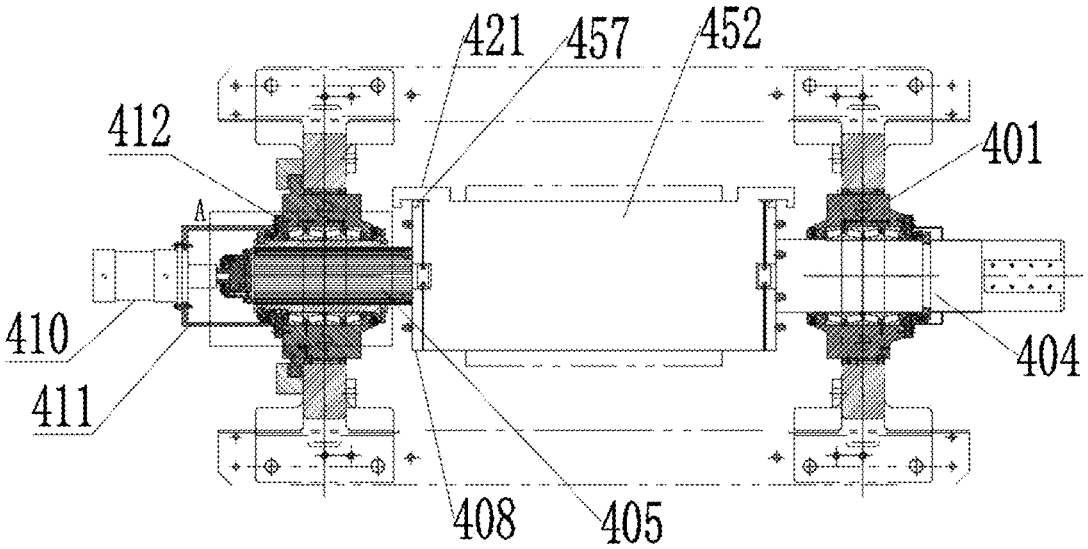
FIG. 8 is an installation structural schematic view of an upper roller provided by the present invention.
Figure 9:
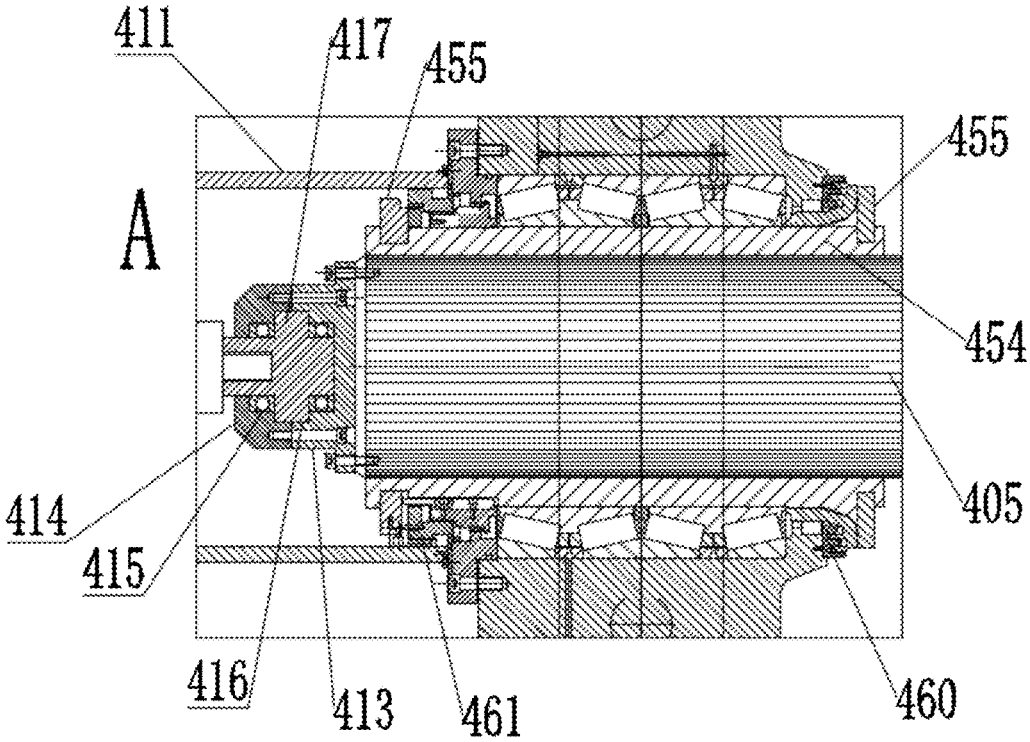
FIG. 9 is a partial enlarged view of block A in FIG. 8.
Figure 10:
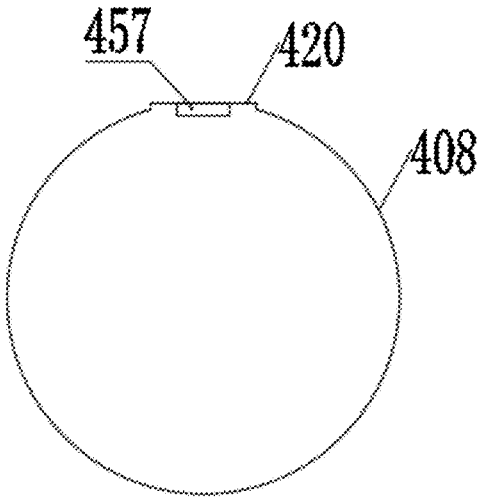
FIG. 10 is a side view of the upper roller of the large-scale axle intelligent cross wedge rolling mill provided by the present invention.
Figure 11:
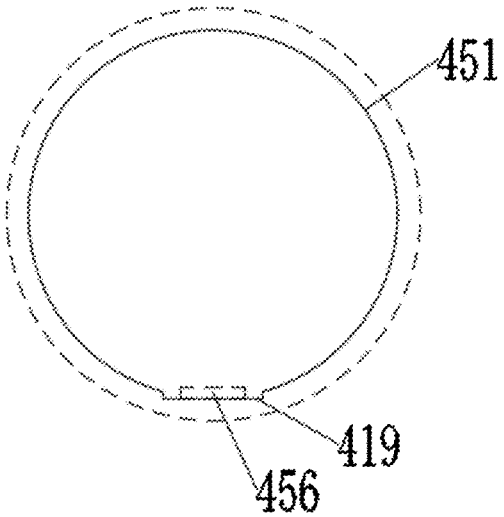
FIG. 11 is a side view of a lower roller of the large-scale axle intelligent cross wedge rolling mill provided by the present invention.
Figure 12:
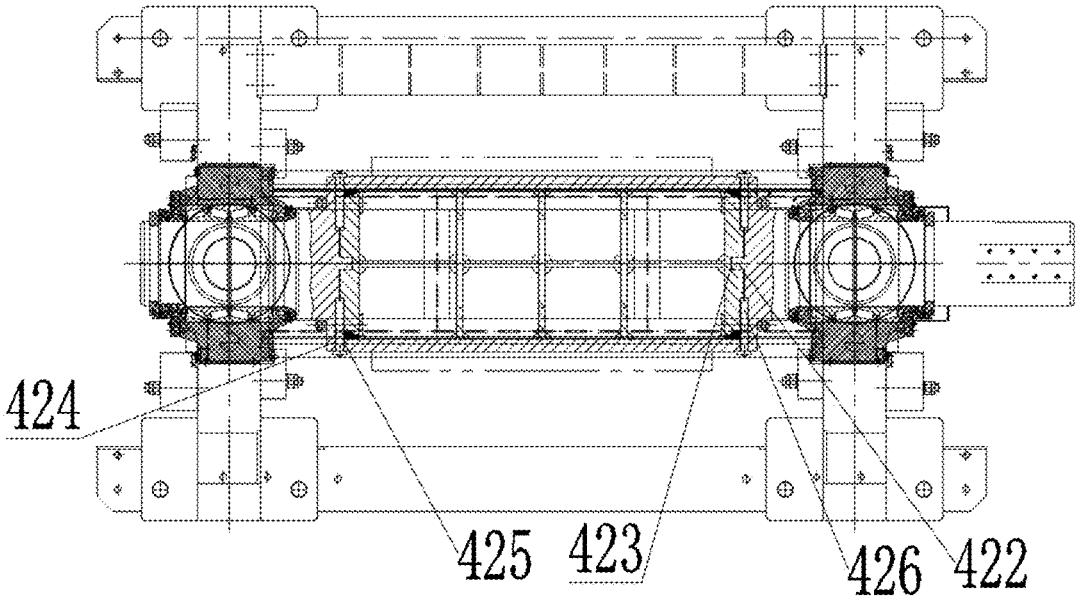
FIG. 12 is a sectional view of the upper roller provided by the present invention.
Figure 13:
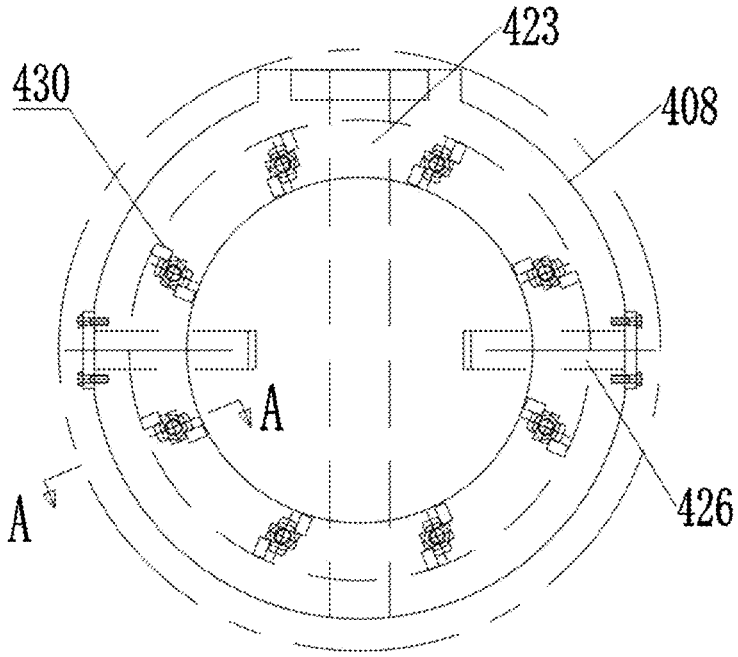
FIG. 13 is an installation side view of the upper roller provided by the present invention.
Figure 14:
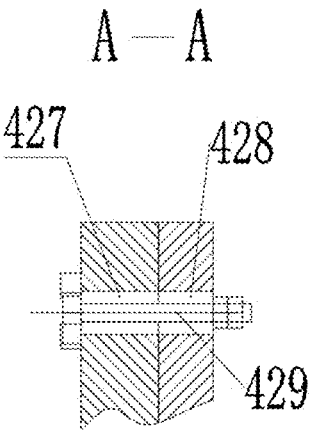
FIG. 14 is a sectional view along A-A in FIG. 13.
Figure 15:
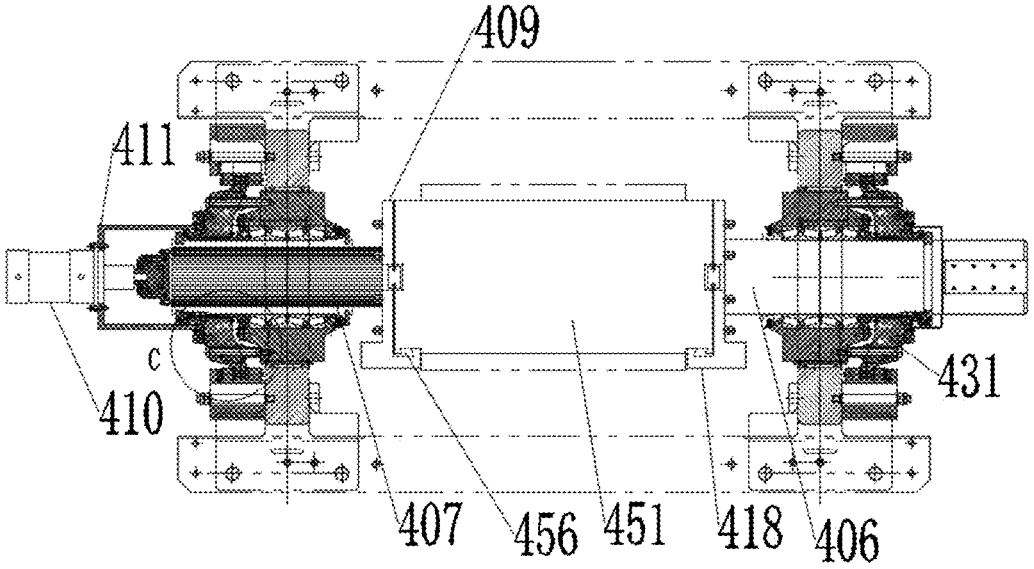
FIG. 15 is an installation side view of the lower roller provided by the present invention.
Figure 16:
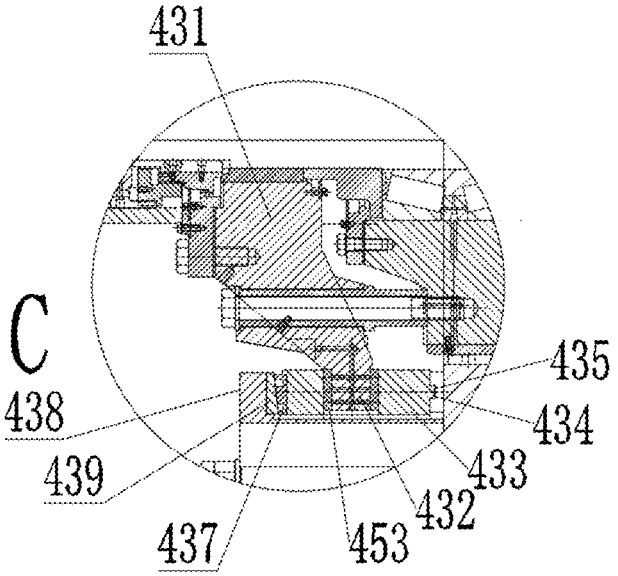
FIG. 16 a partial enlarged view of circle C in FIG. 14.
Figure 17:
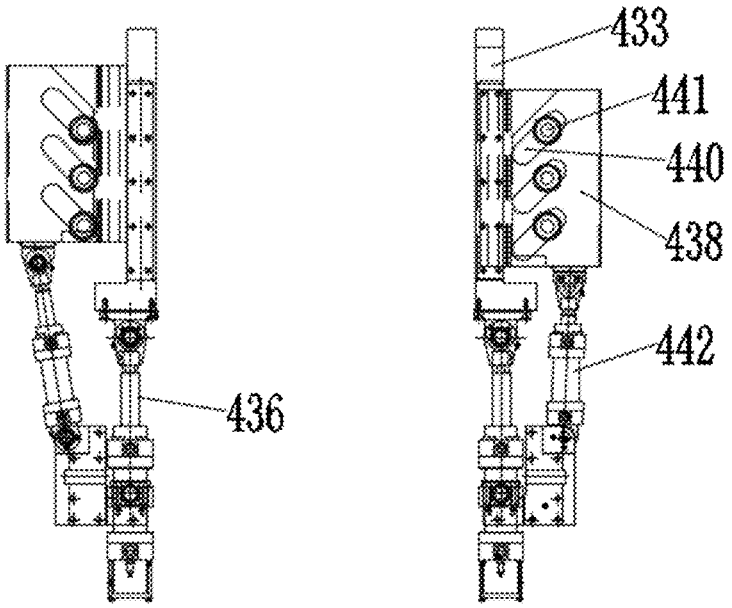
FIG. 17 is a structural schematic view of an axial movement device without a slider seat of the large-scale axle intelligent cross wedge rolling mill provided by the present invention.
Figure 18:
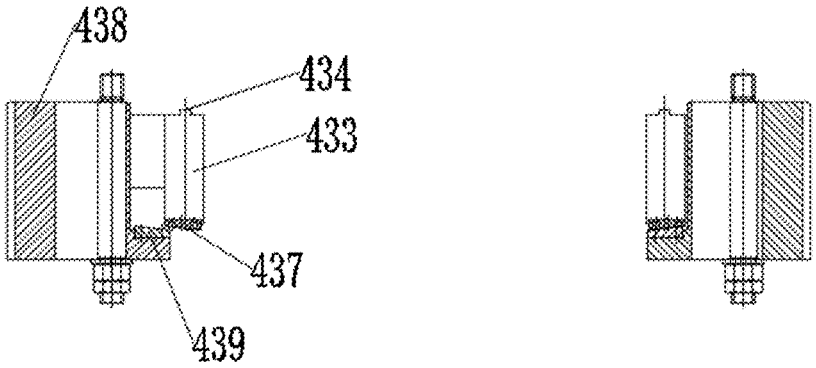
FIG. 18 is a top view of the axial movement device without the slider seat provided by the present invention.
Figure 19:
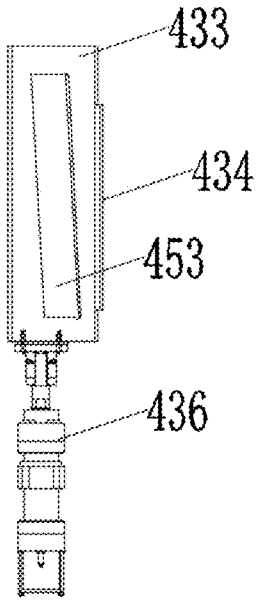
FIG. 19 is a schematic view of the connection between a movement adjustment block and a movement hydraulic cylinder of the large-scale axle intelligent cross wedge rolling mill provided by the present invention.
Figure 20:
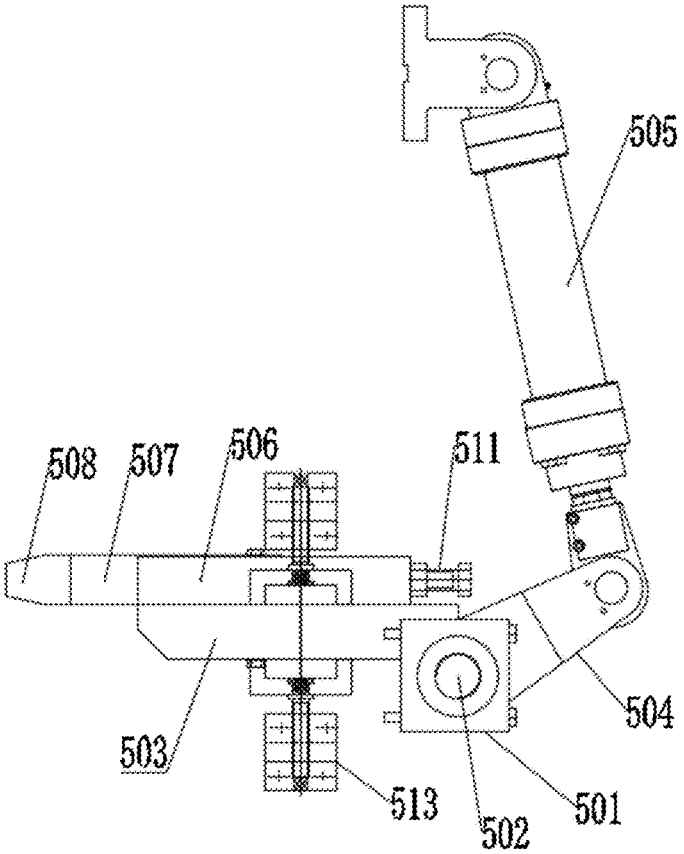
FIG. 20 is a side view of the guide device of the large-scale axle intelligent cross wedge rolling mill provided by the present invention.
Figure 21:
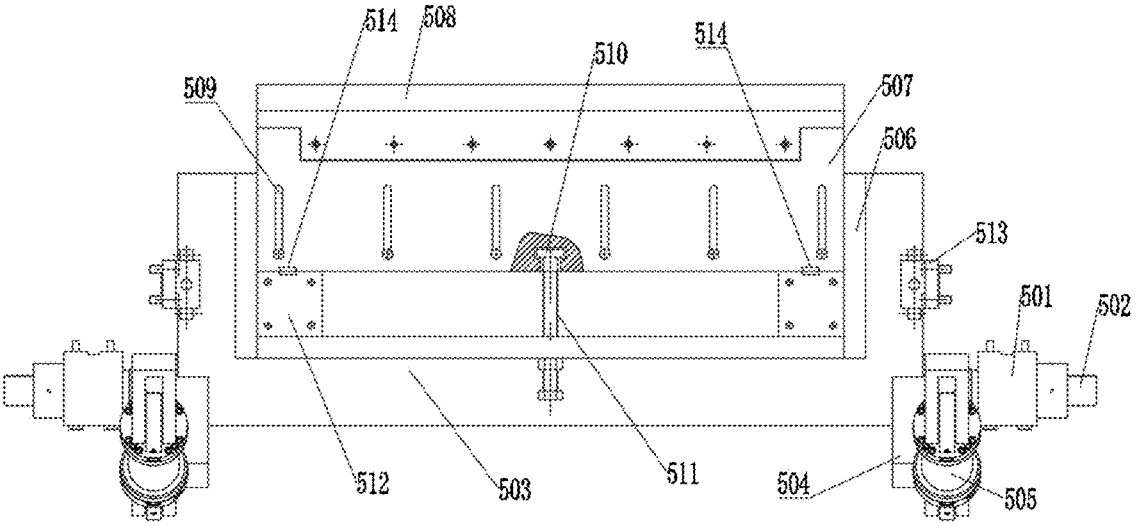
FIG. 21 is a top view of the guide device provided by the present invention.
Figure 22:
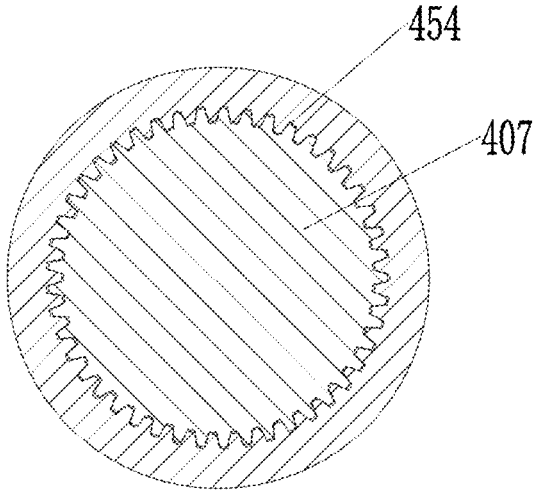
FIG. 22 is a schematic view of the connection between a lower slide shaft and a separation sleeve of the large-scale axle intelligent cross wedge rolling mill provided by the present invention.
Figure 23:
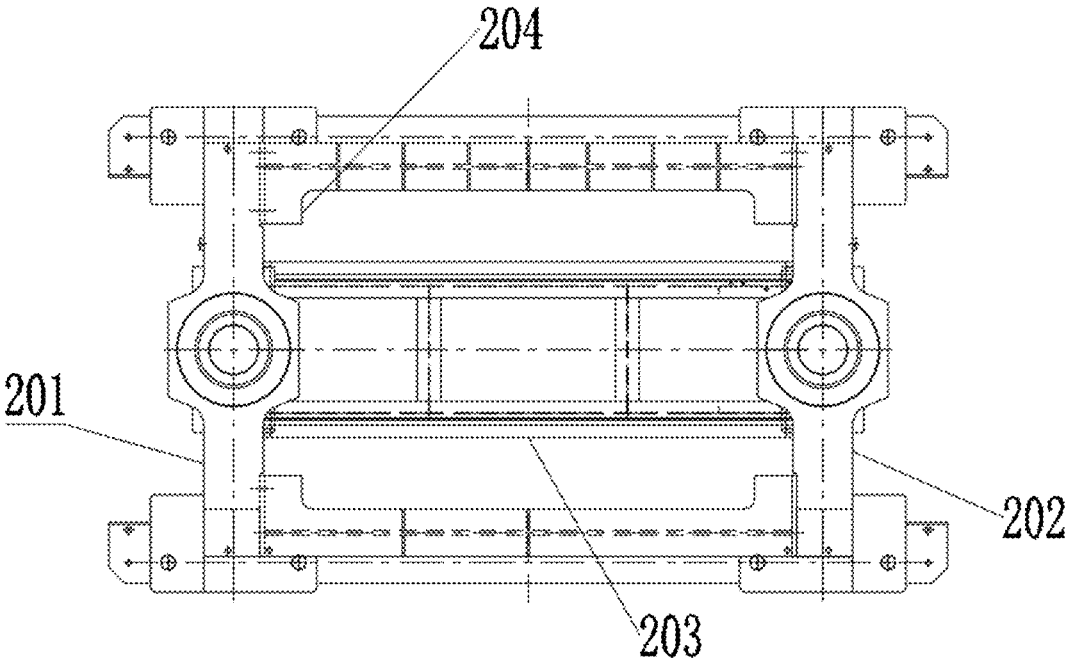
FIG. 23 is a top view of a memorial arch unit of the large-scale axle intelligent cross wedge rolling mill provided by the present invention.

In the drawings, 1: main transmission device; 2: memorial arch unit; 3: worm-gear pressing device; 4: roll assembly; 5: guide device; 101: main drive motor; 102: primary reducer; 103: transfer case; 104: universal coupling; 201: left memorial arch; 202: right memorial arch; 203: I-beam; 204: C-shaped beam; 401: upper bearing seat; 402: lower bearing seat; 403: clamping sleeve; 404: upper transmission shaft; 405: upper slide shaft; 406: lower transmission shaft; 407: lower slide shaft; 408: upper shaft neck; 409: lower shaft neck; 410: clamping hydraulic cylinder; 411: protective case; 412: bearing end cover; 413: connection sleeve body; 414: connection sleeve end cover; 415: installation slot; 416: limit slot; 417: circular limit block; 418: first positioning hook; 419: first positioning surface; 420: second positioning surface; 421: second positioning hook; 422: guide key; 423: guide groove; 424: first horizontal slot; 425: second horizontal slot; 426: strengthen key; 427: first rectangular through hole; 428: second rectangular through hole; 429: T-shaped bolt; 430: fixture block; 431: slider seat; 432: inclined slider; 433: movement adjustment block; 434: limit slider; 435: limit slide slot; 436: movement hydraulic cylinder; 437: first lock ramp slider; 438: lock block; 439: second lock ramp slider; 440: lock slide slot; 441: lock bolt; 442: locking hydraulic cylinder; 443: dovetailed limit block; 444: prestressed plate; 445: dovetailed slot; 446: prestressed seat; 447: prestressed threaded rod; 448: limit groove; 449: connection cover; 450: connection block; 451: lower roller; 452: upper roller; 453: inclined slide slot; 454: separation sleeve; 455: limit ring; 456: first hook groove; 457: second hook groove; 458: first pressure sensor; 459: creepmeter; 460: labyrinth cover; 461: positioning sleeve; 501: installation seat; 502: tie rod; 503: guide plate seat; 504: hinge ear; 505: guide hydraulic cylinder; 506: guide slot; 507: guide plate; 508: guide bar; 509: bolt slide slot; 510: bolt limit block; 511: fastening bolt; 512: spacer; 513: fixed frame; 514: second pressure sensor.

DETAILED DESCRIPTION OF THE PREFERRED EMBODIMENT

The present invention is further explained in detail with reference to embodiments as follows.

A large-scale axle intelligent cross wedge rolling mill for rail transit comprises a main transmission device 1, a memorial arch unit 2, two worm-gear pressing devices 3, a roll assembly 4 and two guide devices 5, wherein:

the main transmission device 1 comprises a main drive motor 101, a primary reducer 102 and a transfer case 103, wherein an output shaft of the main drive motor 101 is connected with an input shaft of the primary reducer 102, an output shaft of the primary reducer 102 is connected with an input shaft of the transfer case 103, two output shafts of the transfer case 103 are connected with an upper transmission shaft 404 and a lower transmission shaft 406 through two universal couplings 104, respectively;

the memorial arch unit 2 comprises a left memorial arch 201, a right memorial arch 202, an I-beam 203 for connecting a lower end of the left memorial arch 201 with a lower end of the right memorial arch 202, and two C-shaped beams 204 for connecting an upper end of the left memorial arch 201 with an upper end of the right memorial arch 202, wherein the C-shaped beams 204 are configured to roll replacement;

the two worm-gear pressing devices 3 are installed at the upper end of the left memorial arch 201 and the upper end of the right memorial arch 202, respectively;

the roll assembly 4 comprises two upper bearing seats 401 and two lower bearing seats 402, wherein:

one of the two upper bearing seats 401 and one of the two lower bearing seats 402 are installed within the left memorial arch 201, another of the two upper bearing seats 401 and another of the two lower bearing seats 402 are installed within the right memorial arch 202;

two clamping sleeves 403 fixed on an upper surface of the two upper bearing seats 401, respectively;

an end portion of two pressing screws of the two worm-gear pressing devices 3 is provided within the two clamping sleeves 403 for connecting the two worm-gear pressing devices 3 with the two upper bearing seats 401, respectively;

an upper transmission shaft 404 and an upper slide shaft 405 are provided within the two upper bearing seats 401, respectively;

a lower transmission shaft 406 and a lower slide shaft 407 are provided within the two lower bearing seats 402, respectively;

two upper shaft necks 408 are integrated with an inner side end of the upper transmission shaft 404 and an inner side end of the upper slide shaft 405, respectively;

two lower shaft necks 409 are integrated with an inner side end of the lower transmission shaft 406 and an inner side end of the lower slide shaft 407, respectively;

a distance between the two lower shaft necks 409 is smaller than a distance between the two upper shaft necks 408;

all of two side walls of an upper roller 452 and two side walls of a lower roller 451 have multiple first rectangular through holes 427 circumferentially evenly provided therein;

all of the two upper shaft necks 408 and the two lower shaft necks 409 have multiple second rectangular through holes 428, wherein the multiple first rectangular through holes 427 are communicated with the multiple second rectangular through holes 428 one to one, respectively;

multiple T-shaped bolts 429 are inserted between the multiple first rectangular through holes 427 and the multiple second rectangular through holes 428, respectively;

two fixture blocks 430 are provided at an inner side of each of the multiple first rectangular through holes 427 and are symmetrical to each other with respect to a diagonal line of the each of the multiple first rectangular through holes 427, in such a manner that after an T-shaped end portion of each of the multiple T-shaped bolts 429 is inserted into one of the multiple second rectangular through holes 428, which is communicated with the each of the multiple first rectangular through holes 427, and is rotated by 90 degrees, the each of the multiple T-shaped bolts 429 is stuck between the two fixture blocks 430 to avoid rotation; another end portion of the each of the multiple T-shaped bolts 429 penetrates through the one of the multiple second rectangular through holes 428 and is threadedly connected with a nut;

four guide keys 422 are located at a middle portion of two inner side end surfaces of the two upper and lower shaft necks 408, 409 along a vertical direction, respectively;

all of two side faces of the upper roller 452 and two side faces of the lower roller 451 have four guide grooves 423 which match with the guide keys 422, respectively;

all of the two inner side surfaces of the two upper shaft necks 408 and the two inner side surfaces of the two lower shaft necks 409 have four first horizontal slots 424, respectively;

all of the two side faces of the upper roller 452 and the two side faces of the lower roller 451 have four second horizontal slots 425 which are communicated with the four first horizontal slots 424, respectively;

four strengthen keys 426 are inserted into the four first horizontal slots 424 and the four second horizontal slots 425, respectively, so as to improve a torque transmission capacity between the two lower shaft necks 409 and the lower roller 451, the two upper shaft necks 408 and the upper roller 452; each of the four strength keys 426 is fixedly connected with an adjacent lower shaft neck 409 and the lower roller 451, or is fixedly connected with an adjacent upper shaft neck 408 and the upper roller 452 through screws;

two first positioning hooks 418 are integrated with the two lower shaft necks 409, respectively for positioning the lower roller 451;

a left side and a right side of the lower roller 451 have two first positioning surfaces 419 which are corresponding to the two first positioning hooks 418, respectively;

the two first positioning surfaces 419 have two first hook grooves 456 which match with the two first positioning hooks 418, respectively;

the two upper shaft necks 408 have two second positioning surfaces 420 for positioning the upper roller 452, two second positioning hooks 421 are located at a left side and a right side of the upper roller 452 and are corresponding to the two second positioning surfaces 420, respectively, the two second positioning surfaces 420 have two second hook grooves 457 which match with the two second positioning hooks 421, respectively;

four separation sleeves 454 are provided between the upper slide shaft 405 and one of the two upper bearing seats 401, between the lower slide shaft 407 and one of the two lower bearing seats 402, between the upper transmission shaft 404 and another of the two upper bearing seats 401, between the lower transmission shaft 406 and another of the two lower bearing seats 402, respectively; two of the four separation sleeves 454 are connected with the upper slide shaft 405 and the lower slide shaft 407 through splines, respectively;

eight limit rings 455 are provided at two ends of the four separation sleeves 454, respectively; two labyrinth covers 460 are provided between two of the eight limit rings 455 and the one of the two upper bearing seats 401, another two labyrinth covers 460 are provided between another two of the eight limit rings 455 and the one of the two lower bearing seats 402;

multiple positioning sleeves 461 are provided between the eight limit rings 455 and eight bearing end covers 412, respectively, such that one of the two of the four separation sleeves 454, two of the eight bearing end covers 412 and the one of the two upper bearing seats 401 are connected with each other as a whole, another of the two of the four separation sleeves 454, another two of the eight bearing end covers 412 and the one of the two lower bearing seats 402 are connected with each other as a whole;

two end portions of two piston rods of two clamping hydraulic cylinders 410 are rotatably connected with an external side of one end of the upper slide shaft 405 and that of the lower slide shaft 407, respectively;

two cylinder bodies of the two clamping hydraulic cylinders 410 are fixedly installed on two protective cases 411, respectively;

the two protective case 411 are connected with the eight bearing end covers 412, respectively;

the external side of the one end of the upper slide shaft 405 and that of the lower slide shaft 407 are connected with two connection sleeve bodies 413 through screws, respectively;

two connection sleeve end covers 414 are connected with the two connection sleeve bodies 413 through screws, respectively;

two opposite surfaces of the two connection sleeve bodies 413 and the two connection sleeve end covers 414 have two installation slots 415 and two limit slots 416, respectively;

the two connection sleeve bodies 413 and the connection sleeve end covers 414 form two connection sleeves, respectively;

the two end portions of the two piston rods of the two clamping hydraulic cylinders 410 are rotatably connected with the two connection sleeves, respectively;

two bearings are provided between the two installation slots 415 and the two piston rods of the two clamping hydraulic cylinders 410, respectively;

two circular limit blocks 417 which match with the two limit slots 416 are provided on the two piston rods of the two clamping hydraulic cylinders 410, respectively;

two axial movement devices, which are respectively located at an external side surface of the two lower bearing seats 402, comprises two slider seats 431 fixed on an external side of the two lower bearing seats 402 through bolts;

the two protective cases 411 are provided at an external end surface of the two slider seats 431, respectively;

two of the four separation sleeves 454 corresponding to the two lower bearing seats 402, the lower bearing seats 402, the two slider seats 431 and four of the eight bearing end covers 412 corresponding to the two lower bearing seats 402 are respectively connected with each other as a whole through four of the limit rings 455 corresponding to the two lower bearing seats 402, so that the movement of the roll assembly 4 and the axial sliding of the lower slide shaft 407 do not interfere with each other;

two inclined sliders 432 are provided at a front side and a rear side of each of the two slider seats 431, respectively; the two inclined sliders 432 are slidably provided within an inclined slide slot 453 of a movement adjustment block 433, the movement adjustment block 433 is moved up and down to push or compress the two inclined sliders 432 for further axially moving the each of the lower bearing seats 402;

a limit slider 434 is provided at a side of the movement adjustment block 433 which is close to the left memorial arch 201 or the right memorial arch 202, the left memorial arch 201 or the right memorial arch 202 has a limit slide slot 435 which matches with the limit slider 434;

one end of a movement hydraulic cylinder 436 is hinged with a lower end of the movement adjustment block 433, another end of the movement hydraulic cylinder 436 is hinged with the left memorial arch 201 or the right memorial arch 202, so as to drive the movement adjustment block 433 to move up and down;

a first lock ramp slider 437 and a lock block 438 is provided at an external side of the movement adjustment block 433, a second lock ramp slider 439 which is corresponding to the first lock ramp slider 437 is provided on the lock block 438, the movement adjustment block 433 is locked through the second lock ramp slider 439 compressing the first lock ramp slider 437;

the lock block 438 has multiple lock slide slots 440, both the left memorial arch 201 and the right memorial arch 202 have multiple lock bolts 441 which match with the multiple lock slide slots 440, respectively, so as to limit the lock block 438 to slide along the lock slide slots 440;

one end of a locking hydraulic cylinder 442 is hinged with a lower end of the lock block 438, another end of the locking hydraulic cylinder 442 is hinged with the memorial arch unit 2;

two dovetailed limit blocks 443 are provided at a middle portion of an upper end surface of the two lower bearing seats 402, respectively;

two prestressed plates 444 are located above the lower bearing seats 402, respectively;

a lower surface of the two prestressed plates 444 has two dovetailed slots 445 which matches with the two dovetailed limit blocks 443, respectively;

two prestressed seats 446 are provided at a front end and a rear end of an upper surface of each of the two prestressed plates 444, respectively;

two prestressed threaded rods 447 are provided within and threadedly connected with the two prestressed seats 446, respectively;

an upper portion of the two prestressed threaded rods 447 has two limit grooves 448, respectively;

two connection covers 449 are inserted into the two limit grooves 448, and are fixedly connected with two connection blocks 450 which are provided on a lower surface of the two upper bearing seats 401 through screws, respectively;

the two connection blocks 450 are fixedly connected with the two upper bearing seats 401, respectively;

two first pressure sensors 458 are provided between the two prestressed threaded rods 447 and the two connection blocks 450 for detecting the prestressed force, respectively;

two creepmeters 459 are inserted into the left memorial arch 201 and the right memorial arch 202 for detecting deformation thereof, respectively;

the two guide devices 5 are located at a front side and a rear side of the memorial arch unit 2, wherein:

each of the two guide devices 5 comprises two installation seats 501, wherein the two installation seats 501 are fixed on the left memorial arch 201 and the right memorial arch 202, respectively;

a tie rod 502 is installed between the two installation seats 501 for applying a transverse prestressed force between the left memorial arch 201 and the right memorial arch 202;

a guide plate seat 503 is sleeved on the tie rod 502;

two hinge ears 504 are provided at a left end and a right end of an external side of the guide plate seat 503, respectively;

two guide hydraulic cylinders 505 are hinged with the two hinge ears 504, respectively; an upper end of the two guide hydraulic cylinders 505 are hinged with the left memorial arch 201 and the right memorial arch 202, respectively;

an upper surface of the guide plate seat 503 has a guide slot 506; the guide slot 506 and the two hinge ears 504 are provided at two sides of the tie rod 502, respectively;

a guide plate 507 is inserted into the guide slot 506, the guide plate seat 503 is connected with the guide plate 507 through bolts, the guide plate 507 has multiple bolt slide slots 509 therein, a bolt limit block 510 is rotatably installed at a middle portion of an external side of the guide plate 507, the bolt limit block 510 is fixedly connected with an end portion of a fastening bolt 511, the fastening bolt 511 is threadedly connected with an external side wall of the guide slot 506, two spacers 512 are provided between the guide plate 507 and the external side wall of the guide slot 506, respectively, the two spacers 512 are connected with the guide plate seat 503 through screws, two second pressure sensors 514 are provided between the two spacers 512 and the guide plate 507, respectively, a guide bar 508 is connected with an inner side of the guide plate 507 through bolts, four fixed frames 513 are provided at an upper surface and a lower surface of a left side and a right side of the guide plate seat 503, respectively, a side surface of the fixed frames 513 is connected with the left memorial arch 201 or the right memorial arch 202 through screws for enhancing the stability of the guide plate seat 503 in the rolling process.

The working principle of the present invention is described as follows. When the mold needs to be replaced, the T-shaped bolts 429 are loosened, rotated by 90 degrees and then quickly taken out; and then the strengthening keys 426 are removed for separating the upper shaft necks 408 from the upper roller 452, and separating the lower shaft necks 409 from the lower roller 451, respectively; and then the upper roller 452 is lifted out; after lifting out the upper roller 452, the guide hydraulic cylinders 505 are stretched out for turning over the guide plate seat 503 by 90 degrees, so as to complete the assignment; and then the lower roller 453 is lifted out, so that both the upper roller 452 and the lower roller 451 are removed. After the mold is replaced, the reverse operation is performed, both the upper roller 452 and the lower roller 451 are reinstalled into the rolling mill; when the guide bar 508 needs to be replaced, the spacers 512 are firstly removed, and then the fastening bolts 511 are twisted to pull the guide plate 507 back till the guide plate 507 does not collide with the upper roller 452 while being turned over; and then the guide hydraulic cylinders 505 are stretched out for turning over the guide plate seat 503 by 90 degrees, so that the guide plate 507 is turned out, thus the guide bar 508 is disassembled and replaced.

The main features and advantages of the present invention are shown and described above. For those skilled in the art, it is obvious that the present invention is not limited to the details of the above-mentioned exemplary embodiments. Moreover, the present invention is able to be achieved in other specific forms without departing from the spirit or basic characteristics of the present invention. Accordingly, from any point of view, the embodiments should be regarded as exemplary and non-limiting. The protective scope of the present invention is defined by the appended claims rather than the foregoing description. Therefore, all changes falling within the meaning and scope of equivalent elements of the claims are included in the present invention.

In addition, it should be understood that although this specification is described in accordance with the embodiments, not each embodiment only includes an independent technical solution. The description in the specification is only for clarity, and those skilled in the art should regard the specification as a whole. The technical solutions in each embodiment can also be appropriately combined to form other implementations that can be understood by those skilled in the art.

What is claimed is:

1. A large-scale axle intelligent cross wedge rolling mill for rail transit, comprising a main transmission device (1), a memorial arch unit (2), two worm-gear pressing devices (3), a roll assembly (4) and two guide devices (5), wherein:

the main transmission device (1) comprises a main drive motor (101), a primary reducer (102) and a transfer case (103), wherein an output shaft of the main drive motor (101) is connected with an input shaft of the primary reducer (102), an output shaft of the primary reducer (102) is connected with an input shaft of the transfer case (103), two output shafts of the transfer case (103) are connected with an upper transmission shaft (404) and a lower transmission shaft (406) through two universal couplings (104), respectively, the two output shafts of the transfer case (103) rotate in a same direction;

the memorial arch unit (2) comprises a left memorial arch (201), a right memorial arch (202), an I-beam (203) for connecting a lower end of the left memorial arch (201) with a lower end of the right memorial arch (202), and two C-shaped beams (204) for connecting an upper end of the left memorial arch (201) with an upper end of the right memorial arch (202), wherein the C-shaped beams (204) are used to give way for lifting out and replacing a roller;

the two worm-gear pressing devices (3) are installed at the upper end of the left memorial arch (201) and the upper end of the right memorial arch (202), respectively;

the roll assembly (4) comprises two upper bearing seats (401) and two lower bearing seats (402), wherein:

one of the two upper bearing seats (401) and one of the two lower bearing seats (402) are installed within the left memorial arch (201), another of the two upper bearing seats (401) and another of the two lower bearing seats (402) are installed within the right memorial arch (202);

two clamping sleeves (403) fixed on an upper surface of the two upper bearing seats (401), respectively;

an end portion of two pressing screws of the two worm-gear pressing devices (3) is provided within the two clamping sleeves (403) for connecting the two worm-gear pressing devices (3) with the two upper bearing seats (401), respectively;

an upper transmission shaft (404) and an upper slide shaft (405) are provided within the two upper bearing seats (401), respectively;

a lower transmission shaft (406) and a lower slide shaft (407) are provided within the two lower bearing seats (402), respectively;

two upper shaft necks (408) are integrated with an inner side end of the upper transmission shaft (404) and an inner side end of the upper slide shaft (405), respectively;

two lower shaft necks (409) are integrated with an inner side end of the lower transmission shaft (406) and an inner side end of the lower slide shaft (407), respectively;

a distance between the two lower shaft necks (409) is smaller than a distance between the two upper shaft necks (408);

the two lower shaft necks (409) are detachably connected with a lower roller (451), the upper shaft necks (408) are detachably connected with an upper roller (452);

four separation sleeves (454) are provided between the upper slide shaft (405) and one of the two upper bearing seats (401), between the lower slide shaft (407) and one of the two lower bearing seats (402), between the upper transmission shaft (404) and another of the two upper bearing seats (401), and between the lower transmission shaft (406) and another of the two lower bearing seats (402), respectively;

the separation sleeves (454) adopt an internal spline key structure form, the upper slide shaft (405) or the lower slide shaft (407) adopts an external spline key structure form, two of the four separation sleeves (454) are engaged with the upper slide shaft (405) and the lower slide shaft (407), respectively, so that the upper slide shaft (405) and the lower slide shaft (407) have an axial sliding function and torque transmission function;

eight limit rings (455) are provided at two ends of the four separation sleeves (454), respectively; two labyrinth covers (460) are provided between two of the eight limit rings (455) and the one of the two upper bearing seats (401), another two labyrinth covers (460) are provided between another two of the eight limit rings (455) and the one of the two lower bearing seats (402);

multiple positioning sleeves (461) are provided between the eight limit rings (455) and eight bearing end covers (412), respectively, such that one of the two of the four separation sleeves (454), two of the eight bearing end covers (412) and the one of the two upper bearing seats (401) are connected with each other as a whole, another of the two of the four separation sleeves (454), another two of the eight bearing end covers (412) and the one of the two lower bearing seats (402) are connected with each other as a whole;

two end portions of two piston rods of two clamping hydraulic cylinders (410) are rotatably connected with an external side of one end of the upper slide shaft (405) and that of the lower slide shaft (407), respectively;

two cylinder bodies of the two clamping hydraulic cylinders (410) are fixedly installed on two protective cases (411), respectively;

the two protective case (411) are connected with the eight bearing end covers (412), respectively;

an expansion and contraction of the two clamping hydraulic cylinders (410) are able to realize an axial movement of the upper slide shaft (405) and the lower slide shaft (407); and the two guide devices (5) are located at a front side and a rear side of the memorial arch unit (2).

2. The large-scale axle intelligent cross wedge rolling mill according to claim 1, wherein the external side of the one end of the upper slide shaft (405) and that of the lower slide shaft (407) are connected with two connection sleeve bodies (413) through screws, respectively; two connection sleeve end covers (414) are connected with the two connection sleeve bodies (413) through screws, respectively; two opposite surfaces of the two connection sleeve bodies (413) and the two connection sleeve end covers (414) have two installation slots (415) and two limit slots (416), respectively; the two connection sleeve bodies (413) and the connection sleeve end covers (414) form two connection sleeves, respectively; the two end portions of the two piston rods of the two clamping hydraulic cylinders (410) are rotatably connected with the two connection sleeves, respectively; two bearings are provided between the two installation slots (415) and the two piston rods of the two clamping hydraulic cylinders (410), respectively; two circular limit blocks (417) which match with the two limit slots (416) are provided on the two piston rods of the two clamping hydraulic cylinders (410), respectively.

3. The large-scale axle intelligent cross wedge rolling mill according to claim 1, wherein two first positioning hooks (418) are integrated with the two lower shaft necks (409), respectively for positioning the lower roller (451); a left side and a right side of the lower roller (451) have two first positioning surfaces (419) which are corresponding to the two first positioning hooks (418), respectively; the two first positioning surfaces (419) have two first hook grooves (456) which match with the two first positioning hooks (418), respectively; the two upper shaft necks (408) have two second positioning surfaces (420) for positioning the upper roller (452), two second positioning hooks (421) are located at a left side and a right side of the upper roller (452) and are corresponding to the two second positioning surfaces (420), respectively, the two second positioning surfaces (420) have two second hook grooves (457) which match with the two second positioning hooks (421), respectively.

4. The large-scale axle intelligent cross wedge rolling mill according to claim 1, wherein four guide keys (422) are located at a middle portion of two inner side end surfaces of the two upper and lower shaft necks (408), (409) along a vertical direction, respectively; all of two side faces of the upper roller (452) and two side faces of the lower roller (451) have four guide grooves (423) which match with the guide keys (422), respectively.

5. The large-scale axle intelligent cross wedge rolling mill according to claim 1, wherein all of the two inner side surfaces of the two upper shaft necks (408) and the two inner side surfaces of the two lower shaft necks (409) have four first horizontal slots (424), respectively; all of the two side faces of the upper roller (452) and the two side faces of the lower roller (451) have four second horizontal slots (425) which are communicated with the four first horizontal slots (424), respectively; four strengthen keys (426) are inserted into the four first horizontal slots (424) and the four second horizontal slots (425), respectively, so as to improve a torque transmission capacity between the two lower shaft necks (409) and the lower roller (451), and the two upper shaft necks (408) and the upper roller (452); each of the four strength keys (426) is fixedly connected with an adjacent lower shaft neck (409) and the lower roller (451), or is fixedly connected with an adjacent upper shaft neck (408) and the upper roller (452) through screws.

6. The large-scale axle intelligent cross wedge rolling mill according to claim 1, wherein all of two side walls of an upper roller (452) and two side walls of a lower roller (451) have multiple first rectangular through holes (427) circumferentially evenly provided therein; all of the two upper shaft necks (408) and the two lower shaft necks (409) have multiple second rectangular through holes (428), wherein the multiple first rectangular through holes (427) are communicated with the multiple second rectangular through holes (428) one to one, respectively; multiple T-shaped bolts (429) are inserted between the multiple first rectangular through holes (427) and the multiple second rectangular through holes (428), respectively; two fixture blocks (430) are provided at an inner side of each of the multiple first rectangular through holes (427) and are symmetrical to each other with respect to a diagonal line of the each of the multiple first rectangular through holes (427), in such a manner that after an T-shaped end portion of each of the multiple T-shaped bolts (429) is inserted into one of the multiple second rectangular through holes (428), which is communicated with the each of the multiple first rectangular through holes (427), and is rotated by 90 degrees, the each of the multiple T-shaped bolts (429) is stuck between the two fixture blocks (430) to avoid rotation; another end portion of the each of the multiple T-shaped bolts (429) penetrates through the one of the multiple second rectangular through holes (428) and is threadedly connected with a nut; while disassembling the upper roller (452) and the lower roller (451), the T-shaped bolts (429) are loosened and reversely rotate by 90 degrees, so that the T-shaped bolts (429) are quickly pulled out.

7. The large-scale axle intelligent cross wedge rolling mill according to claim 2, wherein two axial movement devices, which are respectively located at an external side surface of the two lower bearing seats (402), comprises two slider seats (431) fixed on an external side of the two lower bearing seats (402) through bolts;

the two protective cases (411) are provided at an external end surface of the two slider seats (431), respectively;

two of the four separation sleeves (454) corresponding to the two lower bearing seats (402), the lower bearing seats (402), the two slider seats (431) and four of the eight bearing end covers (412) corresponding to the two lower bearing seats (402) are respectively connected with each other as a whole through four of the limit rings (455) corresponding to the two lower bearing seats (402), so that the movement of the roll assembly (4) and the axial sliding of the lower slide shaft (407) do not interfere with each other;

two inclined sliders (432) are provided at a front side and a rear side of each of the two slider seats (431), respectively;

the two inclined sliders (432) are slidably provided within an inclined slide slot (453) of a movement adjustment block (433), the movement adjustment block (433) is moved up and down to push or compress the two inclined sliders (432) for further axially moving the each of the lower bearing seats (402);

a limit slider (434) is provided at a side of the movement adjustment block (433) which is close to the left memorial arch (201) or the right memorial arch (202), the left memorial arch (201) or the right memorial arch (202) has a limit slide slot (435) which matches with the limit slider (434);

one end of a movement hydraulic cylinder (436) is hinged with a lower end of the movement adjustment block (433), another end of the movement hydraulic cylinder (436) is hinged with the left memorial arch (201) or the right memorial arch (202), so as to drive the movement adjustment block (433) to move up and down;

a first lock ramp slider (437) and a lock block (438) is provided at an external side of the movement adjustment block (433), a second lock ramp slider (439) which is corresponding to the first lock ramp slider (437) is provided on the lock block (438), the movement adjustment block (433) is locked through the second lock ramp slider (439) compressing the first lock ramp slider (437);

the lock block (438) has multiple lock slide slots (440), both the left memorial arch (201) and the right memorial arch (202) have multiple lock bolts (441) which match with the multiple lock slide slots (440), respectively, so as to limit the lock block (438) to slide along the lock slide slots (440);

one end of a locking hydraulic cylinder (442) is hinged with a lower end of the lock block (438), another end of the locking hydraulic cylinder (442) is hinged with the memorial arch unit (2).

8. The large-scale axle intelligent cross wedge rolling mill according to claim 1, wherein two dovetailed limit blocks (443) are provided at a middle portion of an upper end surface of the two lower bearing seats (402), respectively; two prestressed plates (444) are located above the lower bearing seats (402), respectively; a lower surface of the two prestressed plates (444) has two dovetailed slots (445) which matches with the two dovetailed limit blocks (443), respectively; two prestressed seats (446) are provided at a front end and a rear end of an upper surface of each of the two prestressed plates (444), respectively; two prestressed threaded rods (447) are provided within and threadedly connected with the two prestressed seats (446), respectively; an upper portion of the two prestressed threaded rods (447) has two limit grooves (448), respectively; two connection covers (449) are inserted into the two limit grooves (448), and are fixedly connected with two connection blocks (450) which are provided on a lower surface of the two upper bearing seats (401) through screws, respectively; the two connection blocks (450) are fixedly connected with the two upper bearing seats (401), respectively; two first pressure sensors (458) are provided between the two prestressed threaded rods (447) and the two connection blocks (450) for detecting the prestressed force, respectively; two creepmeters (459) are inserted into the left memorial arch (201) and the right memorial arch (202) for detecting deformation thereof, respectively.

9. The large-scale axle intelligent cross wedge rolling mill according to claim 1, wherein each of the two guide devices (5) comprises two installation seats (501), wherein the two installation seats (501) are fixed on the left memorial arch (201) and the right memorial arch (202), respectively;

a tie rod (502) is installed between the two installation seats (501) for applying a transverse prestressed force between the left memorial arch (201) and the right memorial arch (202);

a guide plate seat (503) is sleeved on the tie rod (502);

two hinge ears (504) are provided at a left end and a right end of an external side of the guide plate seat (503), respectively;

two guide hydraulic cylinders (505) are hinged with the two hinge ears (504), respectively; an upper end of the two guide hydraulic cylinders (505) are hinged with the left memorial arch (201) and the right memorial arch (202), respectively;

an upper surface of the guide plate seat (503) has a guide slot (506); the guide slot (506) and the two hinge ears (504) are provided at two sides of the tie rod (502), respectively;

a guide plate (507) is inserted into the guide slot (506), the guide plate seat (503) is connected with the guide plate (507) through bolts, the guide plate (507) has multiple bolt slide slots (509) therein, a bolt limit block (510) is rotatably installed at a middle portion of an external side of the guide plate (507), the bolt limit block (510) is fixedly connected with an end portion of a fastening bolt (511), the fastening bolt (511) is threadedly connected with an external side wall of the guide slot (506), two spacers (512) are provided between the guide plate (507) and the external side wall of the guide slot (506), respectively, the two spacers (512) are connected with the guide plate seat (503) through screws, two second pressure sensors (514) are provided between the two spacers (512) and the guide plate (507), respectively, a guide bar (508) is connected with an inner side of the guide plate (507) through bolts.

10. The large-scale axle intelligent cross wedge rolling mill according to claim 9, wherein four fixed frames (513) are provided at an upper surface and a lower surface of a left side and a right side of the guide plate seat (503), respectively, a side surface of the fixed frames (513) is connected with the left memorial arch (201) or the right memorial arch (202) through screws for enhancing a stability of the guide plate seat (503) in a rolling process.

* * * * *